US008801399B2

(12) United States Patent
Kim

(10) Patent No.: US 8,801,399 B2
(45) Date of Patent: Aug. 12, 2014

(54) HERMETIC RECIPROCATING COMPRESSOR

(71) Applicant: Samsung Electronics Co., Ltd., Suwon-si (KR)

(72) Inventor: Jung Hyoun Kim, Gwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 13/872,464

(22) Filed: Apr. 29, 2013

(65) Prior Publication Data

US 2013/0309119 A1 Nov. 21, 2013

(30) Foreign Application Priority Data

May 15, 2012 (KR) ..... 10-2012-0051306

(51) Int. Cl.
*F04B 39/02* (2006.01)

(52) U.S. Cl.
USPC ..... 417/368; 184/6.16

(58) Field of Classification Search
CPC ..... F04B 39/023; F04B 39/0238; F04B 39/0246; F04B 39/02; F04C 29/02; F04C 29/023; F04C 29/025; F04C 29/045; F04C 23/008; Y10S 417/902
USPC ..... 417/366, 368, 372, 902; 184/6.16, 6.18
See application file for complete search history.

(56) References Cited

U.S. PATENT DOCUMENTS

| | | | | |
|---|---|---|---|---|
| 3,848,702 | A * | 11/1974 | Bergman | 184/6.16 |
| 6,450,785 | B1 | 9/2002 | Dellby et al. | |
| 6,666,301 | B2 * | 12/2003 | Kim | 184/6.16 |
| 6,716,001 | B2 * | 4/2004 | Kim | 417/366 |
| 7,532,994 | B2 | 5/2009 | Tada et al. | |
| 7,832,994 | B2 | 11/2010 | Akashi et al. | |
| 2002/0170778 | A1 * | 11/2002 | Kim | 184/6.16 |
| 2002/0172607 | A1 * | 11/2002 | Kim | 417/366 |
| 2004/0151604 | A1 | 8/2004 | Ishida et al. | |
| 2005/0115771 | A1 * | 6/2005 | Shin | 184/6.16 |
| 2006/0013706 | A1 * | 1/2006 | Ishida et al. | 417/386 |

FOREIGN PATENT DOCUMENTS

| | | |
|---|---|---|
| KR | 1998-067150 | 10/1998 |
| KR | 20-0242874 | 10/2001 |

OTHER PUBLICATIONS

International Search Report mailed Jul. 29, 2013 in International Patent Application PCT/KR2013/003819.

* cited by examiner

*Primary Examiner* — Peter J Bertheaud
(74) *Attorney, Agent, or Firm* — Staas & Halsey LLP

(57) ABSTRACT

Disclosed herein is a compressor in which oil retained in a hermetic case may be raised through an inner circumferential surface of a rotating shaft. The rotating shaft is provided with a hollow portion, and a fixation shaft with a spiral wing is inserted into the hollow portion to raise oil. Also, a spiral groove is formed on an outer circumferential surface of the rotating shaft to cause the raised oil to descend and lubricate the outer circumferential surface of the rotating shaft, and the hollow portion and the spiral groove are connected to each other via a guide passage.

8 Claims, 8 Drawing Sheets

HERMETIC RECIPROCATING COMPRESSOR

CROSS-REFERENCE TO RELATED APPLICATIONS

This application claims the priority benefit of Korean Patent Application No. 2012-0051306, filed on May 15, 2012 in the Korean Intellectual Property Office, the disclosure of which is incorporated herein by reference.

BACKGROUND

1. Field

Embodiments relate to an oil supply structure of a hermetic reciprocating compressor in which a compression mechanism to compress a refrigerant through reciprocation of a piston and a power transmission mechanism to generate driving force are integrated and accommodated in a hermetic case.

2. Description of the Related Art

In general, a compressor, which is one of the components of a refrigeration cycle apparatus, is designed to compress a refrigerant at high temperature and high pressure. The compressors may be divided into various types depending on the compression technique and the sealing structure. Among other compressors, the hermetic reciprocating compressor includes a compression mechanism to compress the refrigerant through reciprocation of a piston and a power transmission mechanism to drive the compression mechanism, and has the compression mechanism and the power transmission mechanism installed in one hermetic case.

Such a hermetic reciprocating compressor includes a rotating shaft to transmit driving force from the power transmission mechanism to the compression mechanism. Also, a lower portion of the hermetic case retains oil used to lubricate and cool components of each mechanism, and the rotating shaft is provided with an oil supply structure to raise the oil to supply the same to each component.

An example of such a compressor is disclosed in Korean Patent Application Publication No. 10-2005-0052011. According to this document, an inner channel is provided in the lower portion of the rotating shaft to raise the oil, and a spiral groove connected to the inner channel is formed on the outer circumferential surface of the upper portion of the rotating shaft, which is supported by a shaft support of a frame.

The oil retained in the hermetic case configured as above is guided through the inner channel formed in the rotating shaft to the spiral groove formed on the outer circumferential surface of the rotating shaft. When the oil is raised, it lubricates the parts on the outer circumferential surface of the rotating shaft between the rotating shaft and the shaft support.

However, since the oil lubricates the parts between the rotating shaft and the shaft support while being raised, surface pressure of the shaft support applied to the oil may limit the rising speed of the oil, thus limiting reduction in revolutions per minute (RPM) of the rotating shaft.

SUMMARY

In an aspect of one or more embodiments, there is provided a compressor having an oil supply structure to raise oil retained in the lower portion of a hermetic case, in which the oil is raised even at low revolutions per minute (RPM) of a rotating shaft.

In an aspect of one or more embodiments, there is provided an oil supply structure in which the diameter of a rotating shaft may be minimized.

In an aspect of one or more embodiments, there is provided a compressor which includes a hermetic case to retain oil in a lower portion thereof, a frame accommodated in the hermetic case, a compression mechanism provided with a cylinder fixed to the frame, and a piston to reciprocate to compress a refrigerant in the cylinder, a power transmission mechanism provided with a stator fixed to the frame and a rotor adapted to rotate inside the stator, a rotating shaft coupled to the rotor to rotate together with the rotor and provided with an eccentric part to convert rotational motion of the rotor into translational motion of the piston and a hollow portion to raise the oil retained in the hermetic case, and a fixation shaft inserted into the hollow portion of the rotating shaft, fixed to one of the stator and the frame, and provided with a spiral wing on an outer circumferential surface thereof to raise the oil retained in the hermetic case in cooperation with an inner circumferential surface of the rotating shaft when the rotating shaft rotates.

The frame may include a shaft support to accommodate the rotating shaft to support the rotating shaft, wherein a spiral groove may be formed on an outer circumferential surface of the rotating shaft to lubricate contact surfaces of the rotating shaft and the shaft support.

The rotating shaft may be provided with a guide passage to guide oil in the hollow portion of the rotating shaft to the spiral groove of the rotating shaft.

Also, the spiral groove of the rotating shaft and the spiral wing of the fixation shaft may be formed in opposite directions.

Also, the rotating shaft may be formed of a metal material, and the fixation shaft may be formed of a synthetic resin material.

The compressor may further include a fixing member to fix the fixation shaft to one of the stator and the frame.

The fixing member is a wire coupled to the fixation shaft by penetrating the fixation shaft.

The fixation shaft may include a protrusion protruding downward to be coupled to the fixing member when inserted into the hollow portion of the rotating shaft, wherein the protrusion of the fixation shaft may be provided with a through hole penetrated by the fixing member.

Also, the fixing member may include a coupling portion coupled to the rotating shaft, a hook portion coupled to one of the stator and the frame, and at least one extension to connect the coupling portion with the hook portion, wherein one of the stator and the frame may include a stopping portion allowing the hook portion to be coupled thereto.

At least one extension may include a first extension extending upward from the coupling portion, a second extension extending from the first extension in a radial direction, and a third extension extending upward from the second extension.

In accordance with an aspect of one or more embodiments, there is provided a compressor which includes a hermetic case to retain oil in a lower portion thereof, a frame accommodated in the hermetic case, a compression mechanism provided with a cylinder fixed to the frame, and a piston to reciprocate to compress a refrigerant in the cylinder, a power transmission mechanism provided with a stator fixed to the frame and a rotor adapted to rotate inside the stator, a rotating shaft coupled to an inside of the rotor to rotate together with the rotor and provided with an eccentric part to convert rotational motion of the rotor into translational motion of the piston and a hollow portion to raise the oil retained in the hermetic case, and a spiral member inserted into the hollow portion of the rotating shaft, and coupled to an inner circumferential surface of the rotating shaft to rotate together with the rotating shaft to raise the oil retained in the hermetic case in cooperation with the inner circumferential surface of the rotating shaft.

The compressor may further include a cap member coupled to an end of the rotating shaft to support the spiral member.

The cap member may be provided with a support surface to support the spiral member.

Also, the compressor may further include a fixation shaft inserted into the hollow portion of the rotating shaft to support the spiral member.

The compressor may further include a fixing member to fix the fixation shaft to one of the stator and the frame.

Also, the frame may include a shaft support to accommodate the rotating shaft to support the rotating shaft, wherein a spiral groove may be formed on an outer circumferential surface of the rotating shaft to lubricate contact surfaces of the rotating shaft and the shaft support.

The rotating shaft is provided with a guide passage to guide oil in the hollow portion of the rotating shaft to the spiral groove of the rotating shaft.

In accordance with an aspect of one or more embodiments, there is provided a compressor includes a hermetic case to retain oil in a lower portion thereof, a frame accommodated in the hermetic case, a compression mechanism provided with a cylinder fixed to the frame, and a piston to reciprocate to compress a refrigerant in the cylinder, a power transmission mechanism provided with a stator fixed to the frame and a rotor adapted to rotate inside the stator, and a rotating shaft provided with a hollow portion having a raising member to raise the oil retained in the hermetic case disposed therein, and a spiral groove communicating with the hollow portion and formed on an outer circumferential surface of the rotating shaft, wherein the oil retained in the hermetic case is raised through an inner circumferential surface of the rotating shaft, and the raised oil lubricates the rotating shaft while descending through the spiral groove.

The raising member may be a spiral member.

The raising is a spiral wing of a fixation shaft disposed in the hollow portion of the rotating shaft.

BRIEF DESCRIPTION OF THE DRAWINGS

These and/or other aspects of embodiments will become apparent and more readily appreciated from the following description of embodiments, taken in conjunction with the accompanying drawings of which.

DETAILED DESCRIPTION

Figure 1:
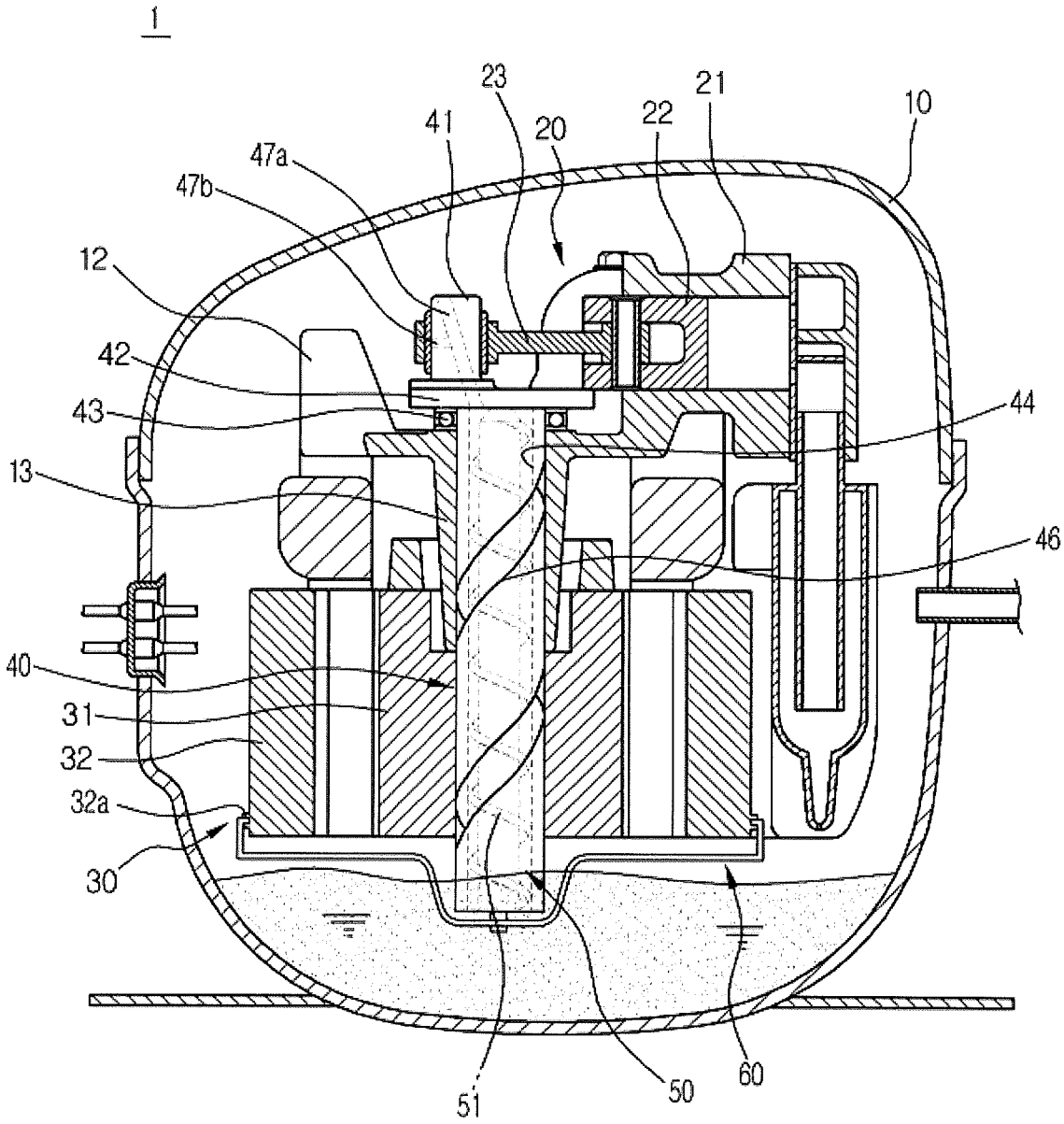
FIG. 1 is a cross-sectional view schematically illustrating a compressor according to an exemplary embodiment.

Reference will now be made in detail to embodiments, examples of which are illustrated in the accompanying drawings, wherein like reference numerals refer to like elements throughout.

Figure 2:
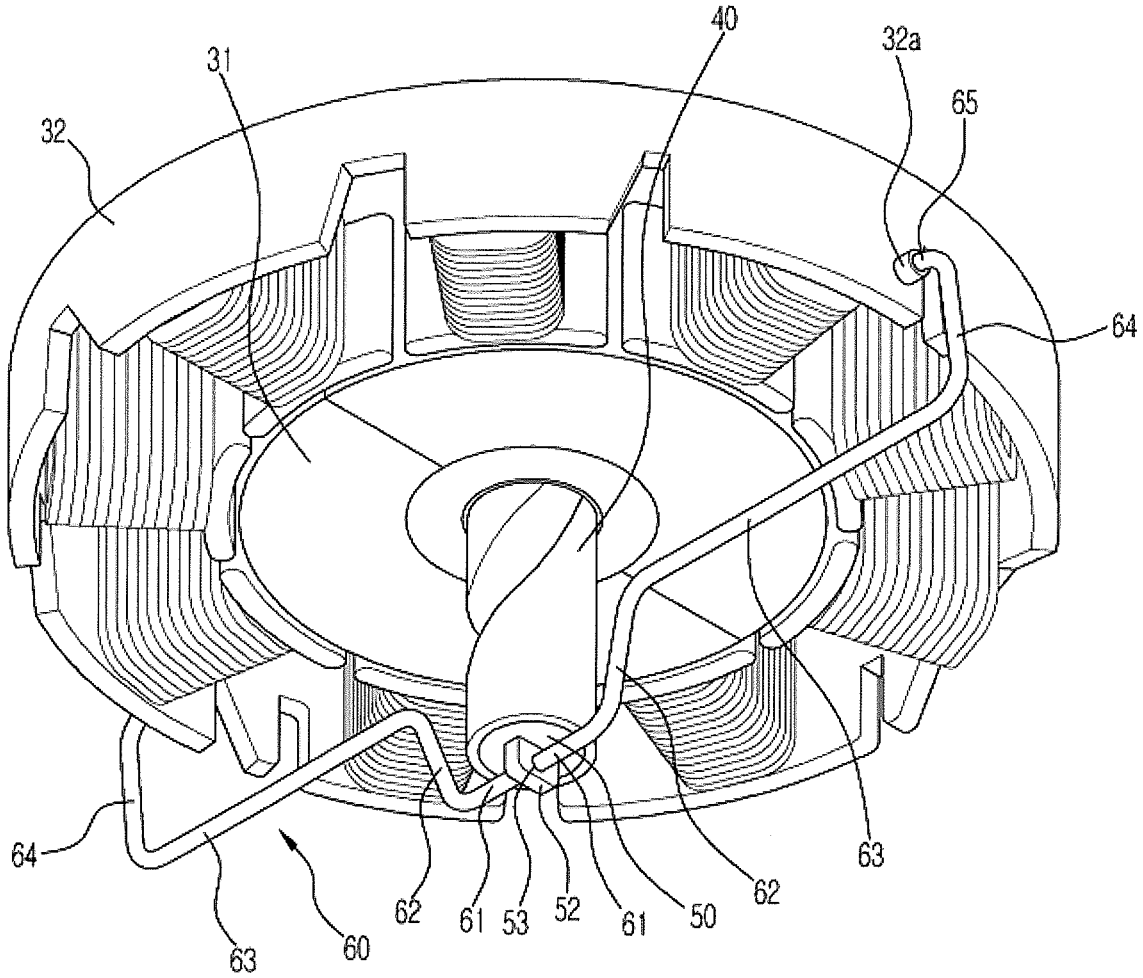
FIG. 2 is a rear perspective view illustrating a fixing structure of a fixation shaft of the compressor in FIG. 1.
Figure 3:
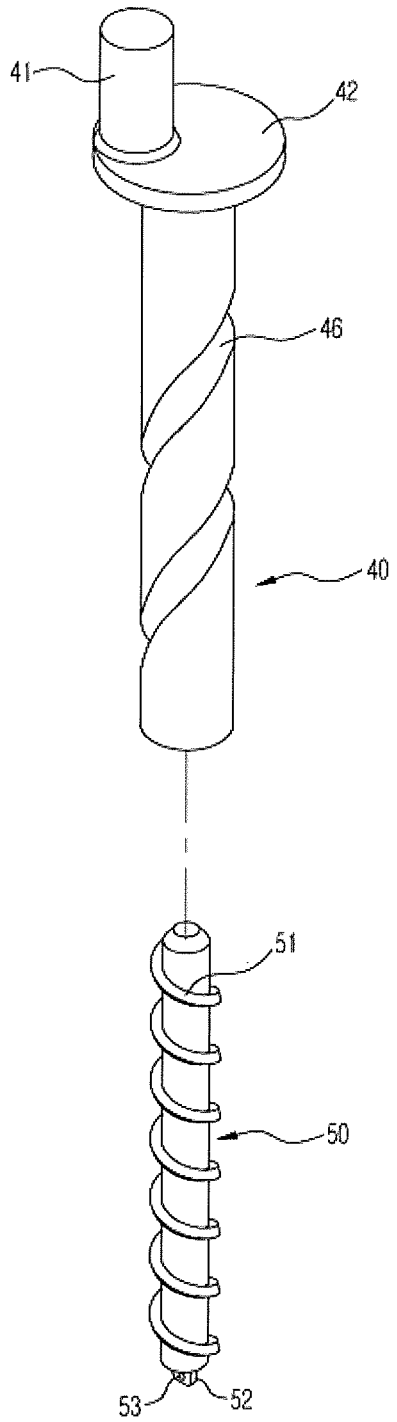
FIG. 3 is an exploded perspective view illustrating coupling between the rotating shaft and the fixation shaft of the compressor of FIG. 1.

FIG. 1 is a cross-sectional view schematically illustrating a compressor according to an exemplary embodiment, FIG. 2 is a rear perspective view illustrating a fixing structure of a fixation shaft of the compressor in FIG. 1, and FIG. 3 is an exploded perspective view illustrating coupling between the rotating shaft and the fixation shaft of the compressor of FIG. 1.

Referring to FIGS. 1 to 3, the compressor 1 includes a hermetic case 10, a frame 12 to fix various components inside the hermetic case 10, a compression mechanism 20 installed at an upper side of the frame 12, a power transmission mechanism 30 installed at a lower side of the frame 12 to drive the compression mechanism 20, and a rotating shaft 40 vertically arranged to transmit driving force from the power transmission mechanism 30 to the compression mechanism 20 and rotatably supported by a shaft support 13 of the frame 12.

The compression mechanism 20 includes a cylinder 21 defining a compression space for a refrigerant and fixed to the frame 12, and a piston 22 to move forward and backward in the cylinder 21 to compress the refrigerant.

The power transmission mechanism 30 includes a stator 32 fixed to the frame 12 and a rotor 31 to rotate inside the stator 32. The rotor 31 includes a through hole to accommodate the rotating shaft 40. The rotating shaft 40 is press-fitted into the through hole of the rotor 31, and is allowed to rotate together with the rotor 31.

An eccentric part 41 eccentrically disposed about the rotational axis is formed at an upper portion of the rotating shaft 40, and is connected to the piston 22 via a connecting rod 23. Accordingly, rotational motion of the rotating shaft 40 may be converted into rectilinear translational motion of the piston 22.

A circular plate 42 extending in a radial direction may be formed at a lower portion of the eccentric part 41. Thrust bearings 43 may be interposed between the circular plate 42 and the shaft support 13 to allow smooth rotation of the rotating shaft 40 and at the same time support an axial load of the rotating shaft 40.

Oil to lubricate and cool various components of the compressor 1 is retained in the lower portion of the hermetic case 10. The oil is raised through the rotating shaft 40 and supplied to the components.

In particular, the rotating shaft 40 is provided with a hollow portion 44 allowing the oil retained in hermetic case to be raised through the inner circumferential surface thereof. A fixation shaft 50 may be inserted into the hollow portion 44. The fixation shaft 50 may be fixed to the stator 32 by a fixing member 60. Accordingly, the fixation shaft 50 may not rotate when the rotating shaft 40 rotates.

The fixation shaft 50 may include, as shown in FIG. 2, a protrusion 52 protruding downward to be coupled to the fixing member 60. The protrusion 52 may be provided with a through hole 53 penetrated by the fixing member 60.

The fixing member 60 may be a wire. The fixing member 60 may be curved at several positions. The fixing member 60 may include a coupling portion 61 to penetrate the through hole 53 of the rotating shaft 40, a hook portion 65 coupled to the stopping portion 32*a* of the stator 32, and extensions 62, 63 and 64 to connect the coupling portion 61 with the hook portion 65.

The stopping portion 32*a* of the stator 32 may have a shape of a groove to accommodate the hook portion 65. The coupling portion 61 of the fixing member 60 may be fitted into the hook portion 65.

The fixing member 60 may be coupled to the stator 32 after the fixation shaft 50 and the fixing member 60 are coupled to each other. That is, the hook portion 65 of the fixing member 60 may be coupled to the stopping portion 32*a* of the stator 32 after the fixing member 60 is inserted into the through hole 53 of the fixation shaft 50.

Here, the fixing member 60 may be formed of an elastic material such as a leaf spring. Therefore, the fixing member 60 may be slightly widened when it is coupled to the stator 32, and after the fixing member 60 is coupled to the stator 32, the fixing member 60 may be firmly coupled to the stator 32 by the restoring force of the fixing member 60.

The extensions 62, 63 and 64 of the fixing member 60 may include a first extension 62 extending approximately upward from the coupling portion 61, a second extension 63 extending in an approximately radial direction from the first extension 62, and a third extension 64 extending approximately upward from the second extension 63.

In the illustrated embodiment, the fixing member 60 is coupled to the stator 32. However, embodiments are not limited thereto. The fixing member 60 may be coupled to the frame 12 or any structure in the hermetic case 10.

A rotating wing 51 may be formed on the outer circumferential surface of the fixation shaft 50 to raise oil retained in the hermetic case 10 in cooperation with the inner circumferential surface of the rotating shaft 40. Accordingly, when the rotating shaft 40 rotates, the oil retained in the hermetic case 10 may be raised along the rotating wing 51 of the fixation shaft 50 as it is rotated by adhesion of the rotating shaft 40 in a direction in which the rotating shaft 40 rotates.

Also, a spiral groove 46 may be formed on the outer circumferential surface of the rotating shaft 40 to allow the raised oil to lubricate and cool the portion between the rotating shaft 40 and the shaft support 13 as the oil descends. A guide passage 45 (FIG. 4) may be provided in the rotating shaft 40 to allow the hollow portion 44 to communicate with the spiral groove 46 therethrough such that the oil in the hollow portion 44 is guided to the spiral groove 46.

Hereinafter, ascent and descent of oil as above will be further described with reference to the drawings.

Figure 4:
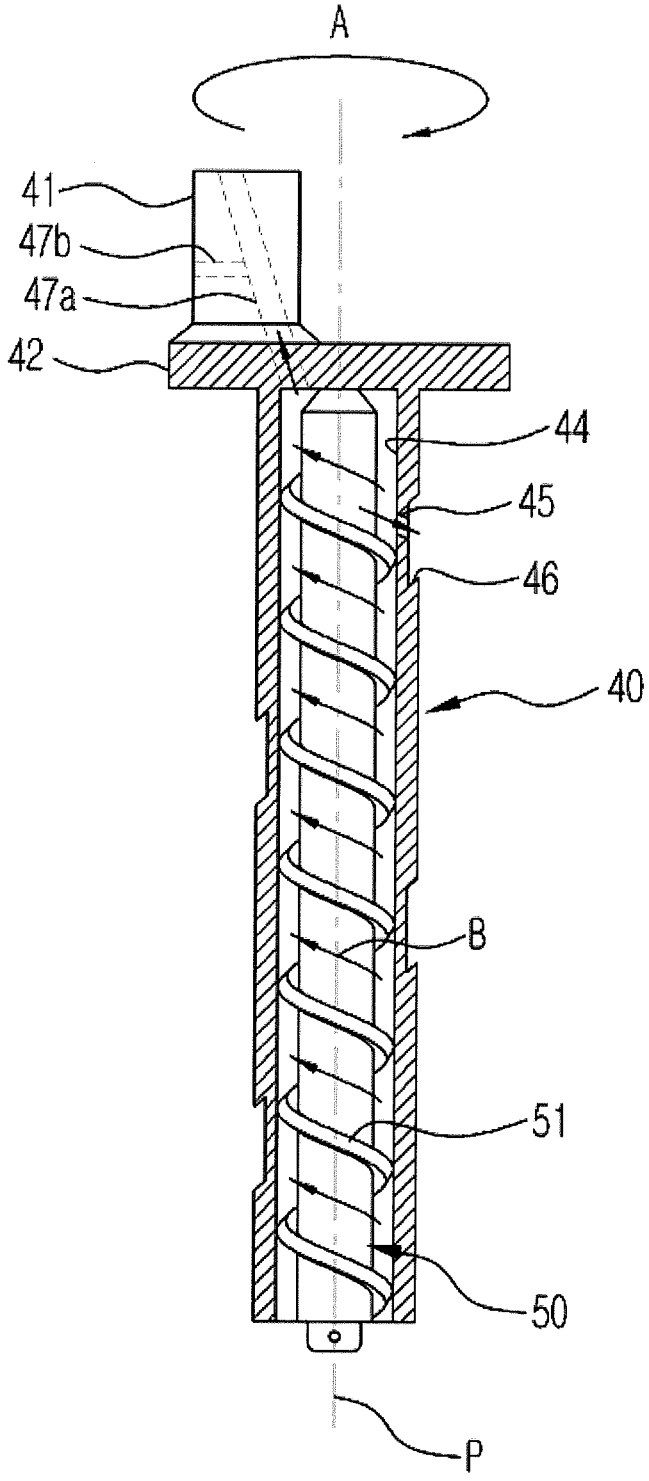
FIG. 4 is a cross-sectional view illustrating ascent of oil of the compressor of FIG. 1.
Figure 5:
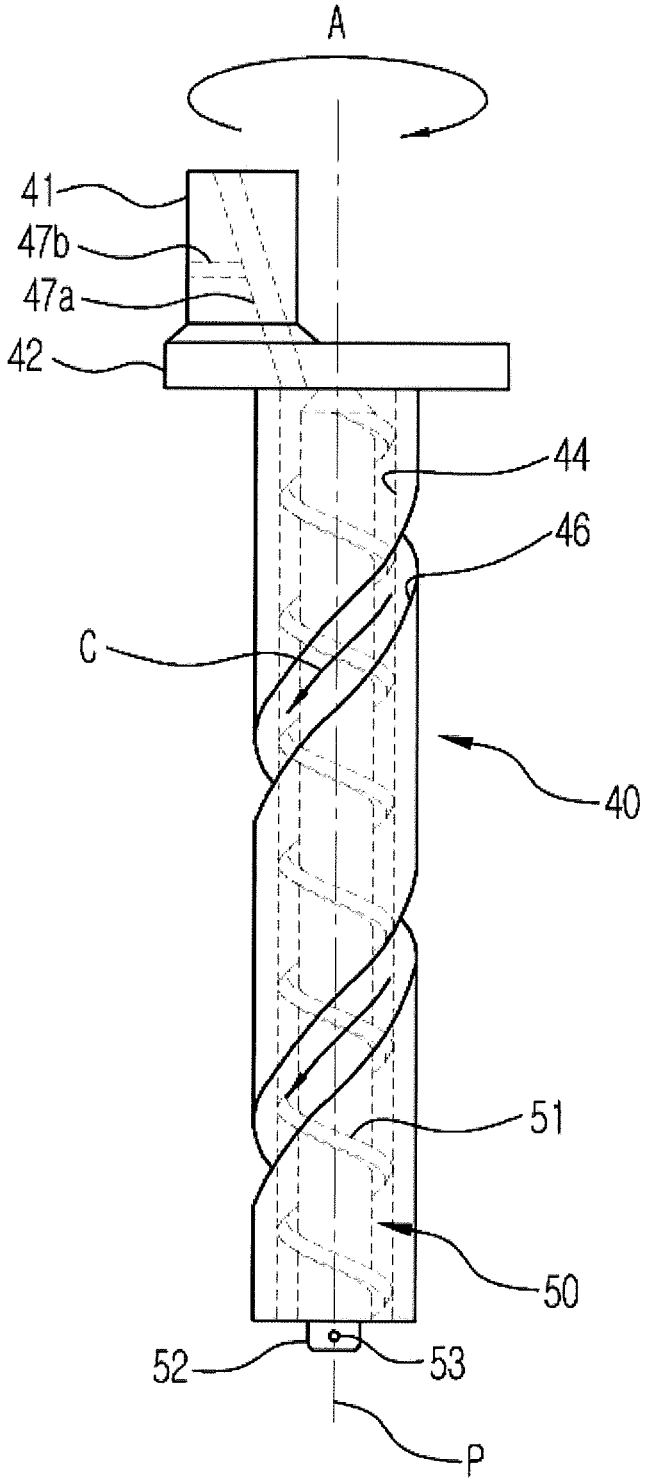
FIG. 5 is a view illustrating descent of oil of the compressor of FIG. 1.

FIG. 4 is a cross-sectional view illustrating ascent of oil of the compressor of FIG. 1, and FIG. 5 is a view illustrating descent of the oil of the compressor of FIG. 1.

In FIG. 4, symbol A, which represents the direction of rotation of the rotating shaft 40, indicates that the rotating shaft 40 rotates clockwise when viewed from the top side of the FIG. 4. Hereinafter, the direction of rotation is the direction when the rotating shaft 40 is viewed from the top side thereof. In FIG. 4, symbol B indicates the direction of ascent of the oil. In FIG. 5, symbol C indicates the direction of descent of the oil.

As shown in FIGS. 4 and 5, when the rotating shaft 40 rotates clockwise, the oil retained in the hermetic case may be rotated clockwise by adhesion thereof to the rotating shaft 40. As the oil rotates clockwise, it may rise along the spiral wing 51 formed on the outer circumferential surface of the fixation shaft 50. That is, centrifugal force according to rotation may be converted into lifting force by the spiral wing 51 such that the oil rises. At this time, the fixation shaft 50 and the spiral wing 51 may not rotate when the rotating shaft 40 rotates as described above.

When the oil is raised to the upper end of the hollow portion 44 of the rotating shaft 40, it may be further raised through a first supply channel 47*a* formed in the eccentric part 41. The first supply channel 47*a* may be formed to be approximately inclined with respect to the central axis P of the rotating shaft. Since the eccentric part 41 eccentrically rotates about the central axis P of the rotating shaft, the oil may be raised from the first supply channel 47*a* by the centrifugal force. The oil raised through the first supply channel 47*a* may be discharged to the upper side of the eccentric part 41 to lubricate the eccentric part 41 and other structures.

Also, a second supply channel 47*b* may be formed in a radial direction at one point in the first supply channel 47*a*. The oil may be supplied to the connecting rod 23 (FIG. 1) through the second supply channel 47*b*.

Also, after the oil is raised to the upper end of the hollow portion 44 of the rotating shaft 40, it may be guided to the spiral groove 46 formed on the outer circumferential surface of the rotating shaft 40 through the guide passage 45. As shown in FIG. 5, the oil guided to the spiral groove 46 may lubricate and cool the outer circumferential surface of the rotating shaft 40 and the inner circumferential surface of the shaft support 13 (FIG. 1) as it descends along the spiral groove 46.

At this time, the oil in the spiral groove 46 may descend by gravity even when the centrifugal force is not present. Thus, the spiral groove 46 may be formed in a direction opposite to the direction in which the spiral wing 51 is formed as shown in FIG. 5. Although not shown, the spiral groove 46 may also be formed in the same direction as the spiral wing 51.

As such, the compressor 1 according to the illustrated embodiment may raise the oil through the inner circumferential surface of the rotating shaft 40. Therefore, compared to a conventional structure in which oil is raised through the outer circumferential surface of the rotating shaft 40, and thereby passage of oil is interfered with by the surface pressure of the shaft support (or adhesion thereof to the shaft support) and thus RPM of the rotating shaft needs to be maintained over a predetermined level to raise the oil, the compressor 1 according to the illustrated embodiment may cause the oil to rise at a lower RPM of the rotating shaft by ensuring that the surface pressure of the shaft support 13 is not applied to the oil when the oil is raised.

For the same reason, since the oil is raised at a lower centrifugal force than in conventional cases, the diameter of the rotating shaft may be reduced.

Figure 6:
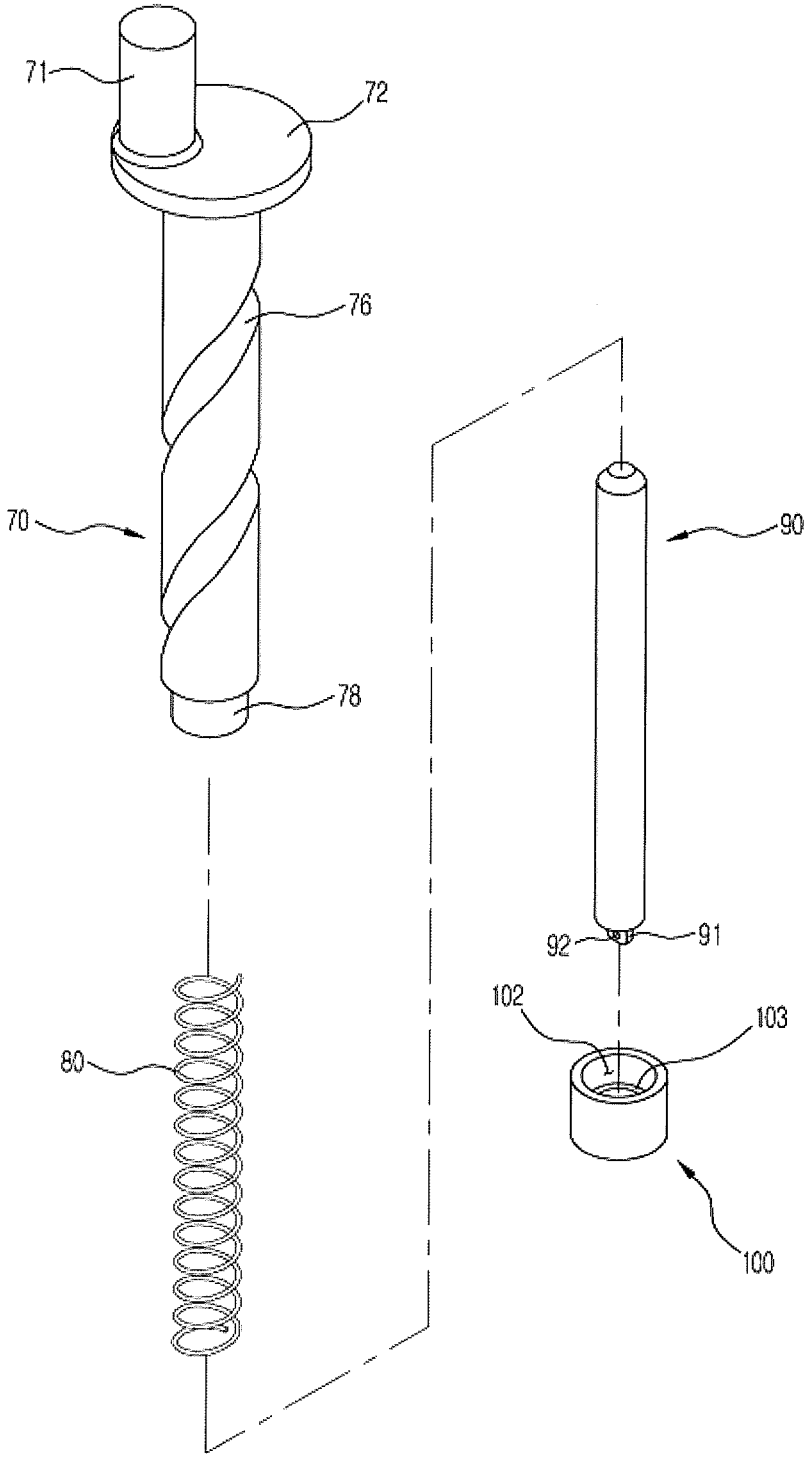
FIG. 6 is an exploded perspective view illustrating coupling between a rotating shaft and a fixation shaft of a compressor according to an exemplary embodiment.
Figure 7:
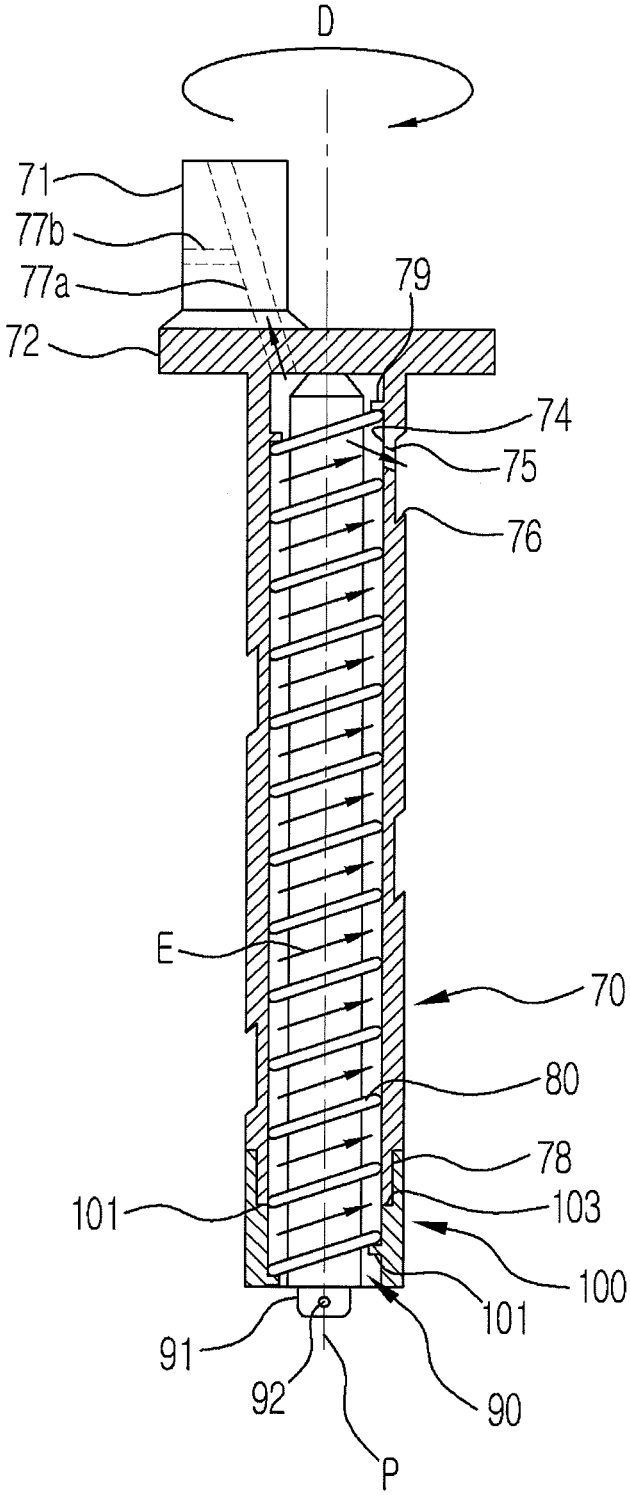
FIG. 7 is a cross-sectional view illustrating ascent of oil of the compressor of FIG. 6.
Figure 8:
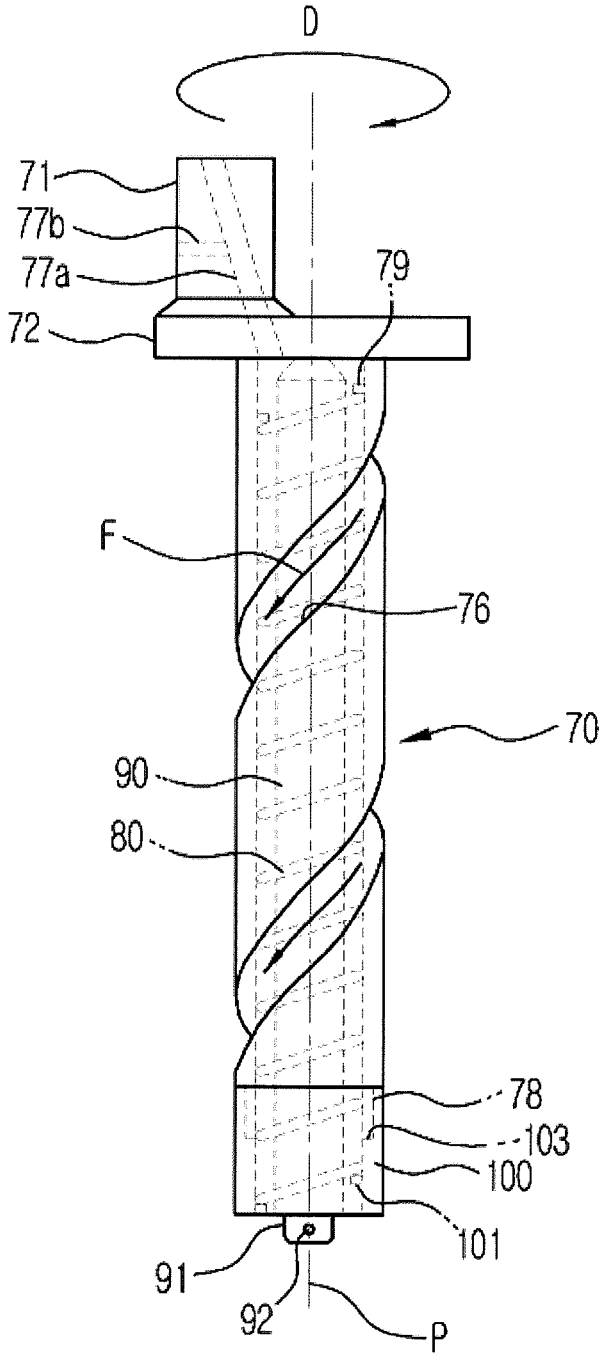
FIG. 8 is a view illustrating descent of oil of the compressor of FIG. 6.

FIG. 6 is an exploded perspective view illustrating coupling between a rotating shaft and a fixation shaft of a compressor according to an exemplary embodiment, FIG. 7 is a cross-sectional view illustrating ascent of oil of the compressor of FIG. 6, and FIG. 8 is a view illustrating descent of oil of the compressor of FIG. 6

A rotating shaft 70, fixation shaft 90, spiral member 80 and cap member 100 of the compressor according to another embodiment will be described below with reference to FIGS. 6 and 7. Other components of the compressor which are not described below are the same as those of the compressor according to the previous embodiment.

The compressor according to the illustrated embodiment may include a rotating shaft 70 having a hollow portion 74, a spiral member 80 inserted into the hollow portion 74 of the rotating shaft 70 to rotate together with the rotating shaft 70 to raise oil in the hermetic case, a cap member 100 coupled to an end of the rotating shaft 70 to support the spiral member 80, and a fixation shaft 90 inserted into the hollow portion 74 of the rotating shaft 70 to support the spiral member 80.

The rotating shaft 70 includes an eccentric part 71 to eccentrically rotate to convert rotational motion of the rotating shaft 70 into rectilinear translational motion, a circular plate 72 formed at the lower side of the eccentric part 71 to support the rotating shaft 70, a hollow portion 74 to raise oil, and a spiral groove 76 allowing the raised oil to descend to lubricate and cool the rotating shaft 70 and surrounding structures thereof.

The eccentric part 71 may be provided with a first supply channel 77*a* to supply the oil raised through the hollow portion 74 to an upper side of the eccentric part 71, and a second supply channel 77*b* to supply the oil raised through the hollow portion 74 to a lateral side of the eccentric part 72.

The rotating shaft 70 may be provided with a guide passage 75 to supply the oil raised through the hollow portion 74 to the spiral groove 76.

The spiral member 80 may be coupled to the hollow portion 74 of the rotating shaft 70 to closely contact the inner circumferential surface of the rotating shaft 70. The spiral member 80 may rotate together with the rotating shaft 70. Therefore, when the rotating shaft 70 rotates in direction D, the spiral member 80 may also rotate in direction D to raise the oil. That is, the spiral member 80 may raise the oil using a vertical component of the centrifugal force. A common spring may be used for the spiral member. A spiral member support 79 to support the upper end of the spiral member 80 may be formed at an upper portion of the rotating shaft 70. The spiral member support 79 may be formed to protrude from the inner circumferential surface of the rotating shaft 70.

The cap member 100 may be coupled to the lower end of the rotating shaft 70 to support the spiral member 80. The insert portion 78 of the rotating shaft 70 may be fitted into the accommodation portion 102 of the cap member 100. Therefore, the cap member 100 may rotate together with the rotating shaft 70 and the spiral member 80. The cap member 100 may be provided with a rotating shaft support surface 103 to closely contact the rotating shaft 70, and a spiral member support 101 to support the lower end of the spiral member 80. The spiral member support 101 may be formed to protrude toward the inside of the cap member 100.

The fixation shaft 90 may be inserted into the hollow portion 74 of the rotating shaft 70 to support the spiral member 80. As in the illustrated embodiment, the fixation shaft 90 may be fixed to the stator 32 (FIG. 1) or the frame 12 (FIG. 1) by the fixing member 60 (FIG. 2). Therefore, the fixation shaft 90 may not rotate together with the rotating shaft 70. The fixation shaft 90 may include a protrusion 91 protruding downward to allow the fixing member 60 to be coupled thereto, a through hole 92 formed at the protrusion 91 to be penetrated by the fixing member 60.

In the compressor having the configuration as above, when the rotating shaft 70 rotates in direction D, the spiral member 80 also rotates in direction D, and thus the oil in the hermetic case may be raised by a vertical component of centrifugal force (E). The oil in the hermetic case may be easily raised, not interfered with by the surface pressure of the shaft support 13. Accordingly, compared to conventional cases, the oil may be raised at low RPM of the rotating shaft, and the diameter of the rotating shaft 70 may be reduced.

The oil raised as above is guided to the spiral groove 76 on the outer circumferential surface of the rotating shaft 70 through the guide passage 75, and may lubricate and cool the adjacent portions of the rotating shaft 70 and the shaft support 13 as it descends along the spiral groove 76 (F).

As is apparent from the above description, oil retained in the hermetic case is allowed to be raised through the inner circumferential surface of the rotating shaft, and not through the outer circumferential surface of the rotating shaft to which the surface pressure of the shaft support is applied, and therefore oil may be raised at a lower RPM than in conventional cases.

Also, the oil may be raised with a lower centrifugal force and thus the diameter of the rotating shaft may be reduced.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A compressor comprising:

a hermetic case to retain oil in a lower portion thereof;

a frame accommodated in the hermetic case;

a compression mechanism provided with a cylinder fixed to the frame, and a piston to reciprocate to compress a refrigerant in the cylinder;

a power transmission mechanism provided with a stator fixed to the frame and a rotor adapted to rotate inside the stator;

a rotating shaft coupled to an inside of the rotor to rotate together with the rotor and provided with an eccentric part to convert rotational motion of the rotor into translational motion of the piston and a hollow portion to raise the oil retained in the hermetic case;

a spiral member inserted into the hollow portion of the rotating shaft, and coupled to an inner circumferential surface of the rotating shaft to rotate together with the rotating shaft to raise the oil retained in the hermetic case in cooperation with the inner circumferential surface of the rotating shaft, wherein the hollow portion has a length which extends substantially the entire length of the rotating shaft, and the spiral member extends substantially the entire length of the hollow portion; and a stationary fixation shaft inserted into the hollow portion, within the spiral member, that does not rotate with the rotating shaft, wherein a spiral groove is formed on an outer circumferential surface of the rotating shaft such that raised oil lubricates the rotating shaft while descending through the spiral groove.

2. The compressor according to claim 1, further comprising a cap member coupled to an end of the rotating shaft to support the spiral member.

3. The compressor according to claim 2, wherein the cap member is provided with a support surface to support the spiral member.

4. The compressor according to claim 1, further comprising a fixing member to fix the fixation shaft to one of the stator and the frame.

5. The compressor according to claim 1, wherein the frame comprises a shaft support to accommodate the rotating shaft to support the rotating shaft.

6. The compressor according to claim 5, wherein the rotating shaft is provided with a guide passage to guide oil in the hollow portion of the rotating shaft to the spiral groove of the rotating shaft.

7. A compressor comprising:

a case to retain oil in a lower portion thereof;

a frame accommodated in the case;

a compression mechanism provided with a cylinder fixed to the frame, the compression mechanism to compress a refrigerant in the cylinder;

a power transmission mechanism provided with a stator fixed to the frame and a rotor adapted to rotate inside the stator;

a rotating shaft provided with a hollow portion;

a stationary fixation shaft inserted into the hollow portion of the rotating shaft, fixed to one of the stator and the frame, wherein the oil retained in the case is raised through a gap formed between an inner circumferential surface of the rotating shaft and the fixation shaft; and a spiral member inserted into the hollow portion of the rotating shaft, surrounding the fixation shaft, and engaged with the inner circumferential surface of the rotating shaft to rotate together with the rotating shaft, wherein the hollow portion has a length which extends substantially the entire length of the rotating shaft, and the spiral member extends substantially the entire length of the hollow portion; and wherein a spiral groove is formed on an outer circumferential surface of the rotating shaft such that raised oil lubricates the rotating shaft while descending through the spiral groove.

8. The compressor of claim 7, wherein the compression mechanism includes a piston to reciprocate to compress the refrigerant in the cylinder, and the rotating shaft is provided with an eccentric part to convert rotational motion of the rotor into translational motion of the piston.

* * * * *